US006450000B2

(12) United States Patent
Barten

(10) Patent No.: US 6,450,000 B2
(45) Date of Patent: Sep. 17, 2002

(54) ROLLER COOLING AND LUBRICATING DEVICE FOR COLD ROLLING MILLS SUCH AS THIN STRIP AND FOIL ROLLING MILLS

(75) Inventor: Axel Barten, Siegen (DE)

(73) Assignee: Achenbach Buschhütten GmbH, Kreuztal (DE)

( * ) Notice: Subject to any disclaimer, the term of this patent is extended or adjusted under 35 U.S.C. 154(b) by 0 days.

(21) Appl. No.: 09/827,704

(22) Filed: Apr. 6, 2001

(30) Foreign Application Priority Data

Apr. 8, 2000 (DE) ..... 200 06 508 U

(51) Int. Cl.[7] ..... B21B 27/06
(52) U.S. Cl. ..... 72/201; 72/236
(58) Field of Search ..... 72/200, 201, 236, 72/342.3; 239/550, 562

(56) References Cited

U.S. PATENT DOCUMENTS 4,510,784 A * 4/1985 Hsu ..... 72/201
4,718,264 A * 1/1988 Guppy et al. ..... 72/201
4,912,955 A * 4/1990 Stines ..... 72/201
4,934,444 A * 6/1990 Frischknecht et al. ..... 72/201

FOREIGN PATENT DOCUMENTS

DE 3419261 11/1985

* cited by examiner

*Primary Examiner*—Ed Tolan
(74) *Attorney, Agent, or Firm*—Friedrich Kueffner

(57) ABSTRACT

A cooling and lubricating device for a cold rolling mill has nozzle beams with spray nozzles for individual rollers that are moveable relative to the rollers independently of one another transverse to the strip running direction. Rotary and linear drives are connected to the nozzle beams for rotating them about the longitudinal axis and moving them longitudinally. The nozzle beams are movable from a maintenance position to a working position and back. The spray nozzles have nozzle holders mounted in openings of the nozzle beams and nozzle heads mounted in the nozzle holders. Rotary slide valves with control members are rotatably supported in center throughbores of the nozzle holders. The rotary slide valves have blind bores opening to the nozzle heads and inlet openings aligned with inlet openings of the nozzle holder or nozzle head, when the spray nozzle is open, and covered by the nozzle holder or nozzle head, when the spray nozzle is closed.

8 Claims, 9 Drawing Sheets

ROLLER COOLING AND LUBRICATING DEVICE FOR COLD ROLLING MILLS SUCH AS THIN STRIP AND FOIL ROLLING MILLS

BACKGROUND OF THE INVENTION

1. Field of the Invention

The invention relates to a roller cooling and/or lubricating device for cold rolling mills for strip, in particular, thin strip rolling mills and foil rolling mills, comprising nozzle beams correlated with the individual rollers and mounted on side shields of the roll housings of one or more roll stands, the nozzle beams having spray nozzles mounted therein across the width of the rollers and being adjustable relative to the correlated rollers independent from one another transverse to the running direction of the rolled strip in planes that are parallel to the strip plane, for the purpose of controlling the strip tensile stress across the strip width by a change of the effective roll barrel diameter and/or by affecting the roller lubrication with a pressure-controlled and/or quantity-controlled and/or temperature-controlled supply of rolling oil or emulsions.

2. Description of the Related Art

The flatness control of the rolled strip in a cold rolling mill for strip, which is furnished with a roller cooling and/or lubricating device of the aforementioned kind known from German patent 34 19 261 C3,is based on a change of the spray pattern of the rolling oil sprayed onto the surface of the working rollers or the sprayed-on emulsions. The change of the spray pattern is effected by an adjustment of the nozzle beam, correlated with each one of the working rollers of the rolling mill, relative to the working roller independent of the respective other nozzle beams transverse to the strip running direction in a plane which is parallel to the strip plane and a pressure-controlled and/or quantity-controlled and/or temperature-controlled supply of rolling oil or emulsions.

Thin strip and foil strip, which are rolled on a four-high or six-high roll stand with the known flatness control, are characterized by a high quality with respect to dimensional precision and shape precision as well as flatness.

A disadvantage of roller cooling and/or lubricating devices of the aforementioned kind for cold rolling mills of strip is the insufficient accessibility of the nozzle beams with the spray nozzles and their corresponding control valves so that repair and maintenance work on the nozzle beams is cumbersome and time-consuming.

SUMMARY OF THE INVENTION

It is an object of the present invention to optimize the control of the strip flatness in cold rolling mills for strip by means of the aforementioned roller cooling and/or lubricating device in order to compensate undesirable strip tensile stress deviations within zones in the rolled strip and to improve the accessibility of the spray nozzles, installed in the nozzle beams of the roller cooling and/or lubricating device, and of their corresponding control valves with respect to a simplification and acceleration of required repair and maintenance work.

In accordance with the present invention, this is achieved in that:

a) the nozzle beams are movable by means of a linear drive (adjusting cylinders) in the direction of their longitudinal axis transverse to the running direction of the rolled strip and rotatable by means of a rotary drive about the longitudinal axis;

b) positioning devices are arranged on the roll stand or the roll stands for moving the nozzle beams from a roller-remote maintenance position into the working position at the rollers and from the working position into the maintenance position;

c) the control valves of the spray nozzles to be opened or closed are switched in a certain time frame with time delay;

d) the spray nozzles, which are mounted at identical spacing within the nozzle beams, have: a nozzle holder, which is inserted into corresponding openings in the front wall section facing a roller as well as the rear wall section of a nozzle beam, sealed relative to the nozzle beam, and penetrates the interior space thereof; moreover, a nozzle head, which is inserted into a bore in the forward end of the nozzle holder facing the roller, preferably is screwed into it, or which is placed onto the forward end of the nozzle holder, preferably screwed thereon, and which has at least one nozzle opening and an ante-chamber; a rotary slide valve which is supported in a central throughbore of the nozzle holder so as to be rotatable about the longitudinal axis of the spray nozzle and has a blind bore open toward the nozzle head and has in the area of the blind bore at least one inlet opening which, in the open position of the spray nozzle, is aligned with a corresponding inlet opening, open toward the interior space of the nozzle beam, of the nozzle holder or the nozzle head, and, in the closed position of the spray nozzle, is closed by a wall of the nozzle holder or the nozzle head; as well as a control member engaging the end of the rotary slide valve remote from the nozzle head.

The roller cooling and/or lubricating device has the following advantages.

The spray angle of the spray nozzles of the nozzle beams relative to the rollers, which is adjustable by rotating the nozzle beams about the longitudinal beam axis, provides a further parameter in addition to the adjustability of the nozzle beams relative to the respectively correlated roller transverse to the strip running direction as well as to the change of the quantity, the pressure, and the temperature of the rolling oil sprayed onto the rollers or the sprayed-on emulsions for changing the spray pattern on the roller surface within the context of a strip flatness control. The spray angle of the spray nozzles as an additional parameter makes possible an optimization of the strip flatness control. By rotating the nozzle beam by 180°, the spray nozzles can be moved in a simple way from the roller-proximal working position into a roller-remote maintenance position for a simple and fast performance of required maintenance and repair work. The positioning devices mounted on the roll stands make possible a simple movement of the nozzle beams from the working position at the rollers into a maintenance position remote therefrom in which all nozzle beams are easily accessible for repair and maintenance work. By the successive switching of the control valves of the spray nozzles to be opened or closed in a certain time frame with a time delay, the pressure in the cooling medium supply lines of the spray nozzles can be maintained substantially constant independent of the number of actuated nozzles so that liquid shocks as a result of pressure fluctuations, which can result in damage to the cooling medium lines and the control valves, are prevented. The rotary slide valve which is used for the spray nozzles of the roller cooling and/or lubricating device requires together with the control member, that, as a result of the small mass of the rotary slide valve, needs only a minimal control force, only little space so that the mounting space necessary across the strip width for each individual spray nozzle is significantly smaller in comparison to known roller cooling and/or lubricating devices, and the spray zone width of the spray nozzles is correspondingly reduced and, accordingly, the precision of the strip flatness control is significantly improved.

The invention will be explained in the following with the aid of schematic drawings of a roller cooling and/or lubricating device used in a four-high stand.

DESCRIPTION OF THE PREFERRED EMBODIMENTS

Figure 1:
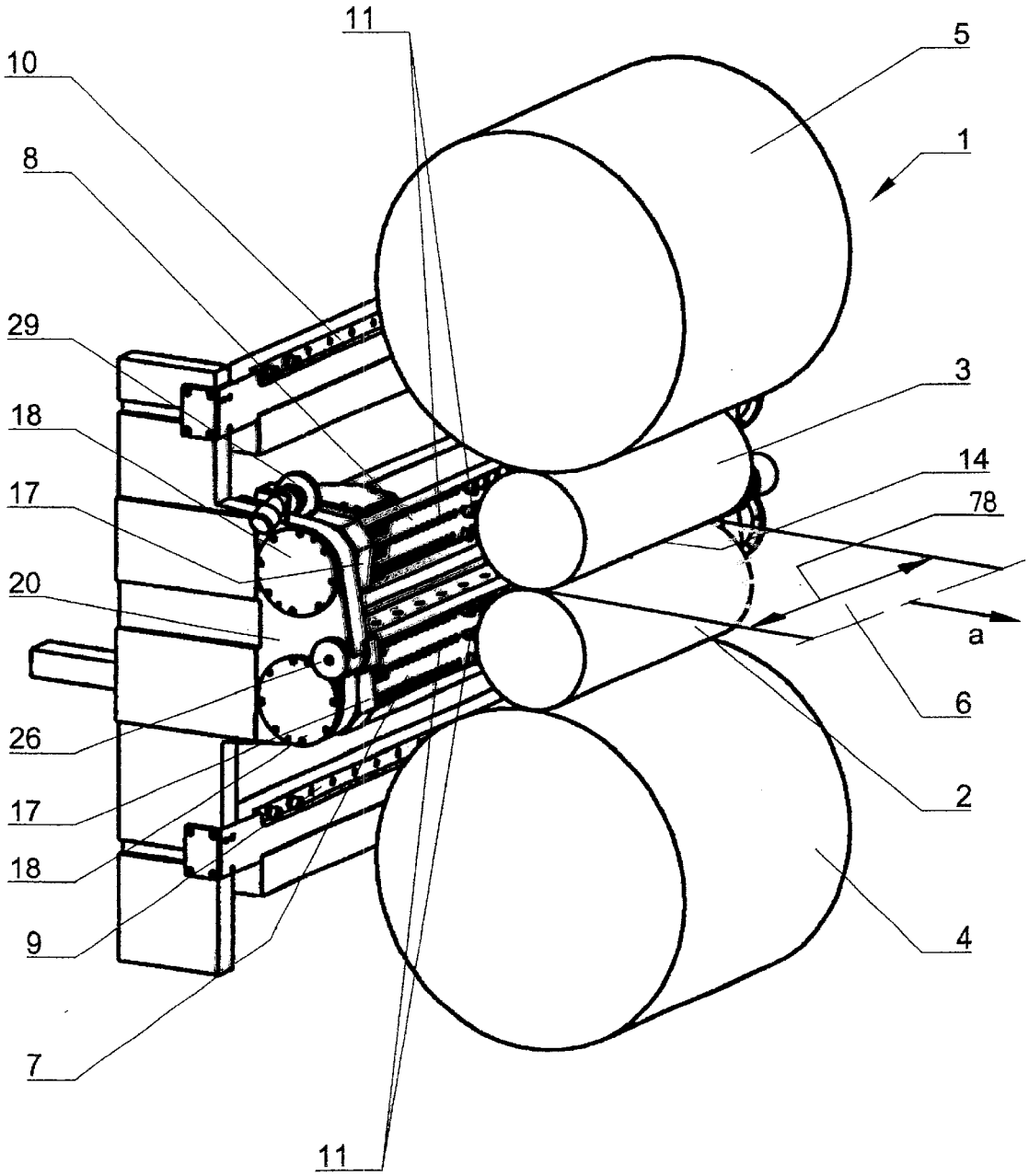
FIG. 1 is a perspective illustration of a four-high stand with nozzle beams for cooling and lubricating the working rollers and the support rollers.
Figure 2:
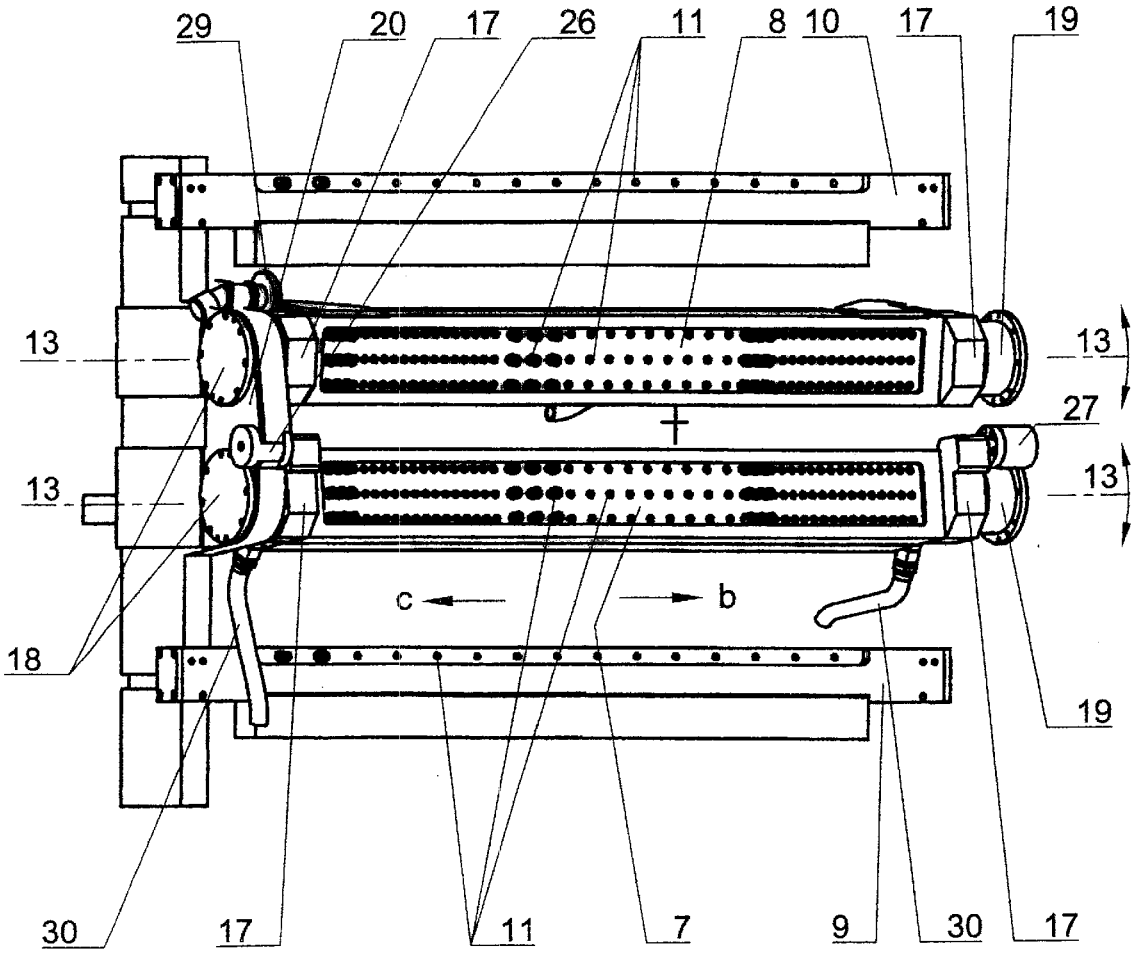
FIG. 2 is a front view of the nozzle beams according to FIG. 1.

The four-high stand of FIG. 1 is comprised of two roll housings, not shown, in which in chocks, not shown, an upper working roller 3 and a lower working roller 2 as well as a lower support roller 4 and an upper support roller 5 are rotatably supported.

The roller cooling and/or lubricating device, suitable for the flatness control of the rolled strip 6, for the working rollers 2, 3 and the support rollers 4, 5 is comprised of a nozzle beam 7, 8, respectively, for the working rollers 2, 3 and a nozzle beam 9, 10 for the support rollers 4, 5, respectively.

Across the width of the rollers, spray nozzles 11 are mounted in the nozzle beams 7–10 with control valves 12, arranged upstream thereof and formed as solenoid valves, for supplying cooling oil and/or emulsions onto the rollers 2–5. The nozzle beams 9, 10 correlated with the support rollers 4, 5 are stationary, while the nozzle beams 7, 8 correlated with the working rollers 2, 3 are slidable in the direction of arrows b, c in the direction of their longitudinal axis 13—13 transverse to the strip running direction a across the strip width and rotatable about their longitudinal axis 13—13.

The respective supply of rolling oil and/or emulsions to the adjustable nozzle beams 7, 8 and the stationary nozzle beams 9, 10 is controlled with pressure control and/or quantity control and/or temperature control.

By a movement of the nozzle beams 7, 8 in the direction of the longitudinal axis 13—13 of the beams transverse to the running direction a of the rolled strip 6 and by rotating the nozzle beams 7, 8 about the longitudinal axis 13—13 of the beam for adjusting the spray angle of the spray nozzles 11 relative to the working rollers 2, 3,the spray zone width of the spray nozzles 11 onto the working rollers 2, 3 and the spray pattern of the spray nozzles 11 are adjusted. The control of pressure, temperature, and quantity of the rolling oil, respectively, of the sprayed-on emulsions supplied to the nozzle beams 7, 8 affects the cooling of the working rollers 2, 3 and thus the size and the speed of the change of the effective roll barrel diameter and of the rolling gap 14, dependant thereon, between the working rollers 2, 3, respectively, affects the lubrication of the working rollers.

By means of a flatness measuring roll, not illustrated, at the exit of the strip behind the roller set, values of the strip tensile stress distribution across the strip width of the rolled strip 6 are measured, then processed in a computer, and used for controlling the cooling and/or the lubrication of the working rollers 2, 3 by means of the movable and rotatable nozzle beams 7, 8.

With a precise positioning of the nozzle beams 7, 8 with the spray nozzles 11, which beams are moveable in the direction of the longitudinal beam axis 13—13 transverse to the strip running direction a and rotatable about the longitudinal beam axis, undesirable strip tensile stress deviations can be compensated in zones within the rolled strip 6,and a planar strip can be produced thereby.

On the two ends 15, 16 of the two nozzle beams 7,8 correlated with the working rollers 2, 3, adaptors 17 are mounted on two hollow bearing journals 18, 19 for rotatable and movable support of the nozzle beams about and in the direction of the longitudinal beam axis 13—13. The bearing journals 18, 19 are provided in the side shields 20, 21 on the two roll housings (not illustrated) of the four-high stand 1 wherein the supply of cooling medium, respectively, of emulsions to the spray nozzles 11 mounted in the nozzle beams 7, 8 and to the corresponding control valves 12 is realized by a supply line 22 in a side shield 20, the hollow space 23 of the bearing journal 18 mounted in the side shield 20,the interior space 24 of the adaptor 17 seated on the bearing journal 18, and the distribution channel 25 of the nozzle beams 7, 8.

The supply of cooling medium to the nozzle beams 7, 8 can also be realized by a respective supply line 22 in both side shields 20, 21, the hollow bearing journals 18, 19 mounted therein, the adaptors 17 seated thereon, and the distribution channel 25 of the nozzle beams.

Hydraulic adjusting cylinders 26, 27 with adjusting pistons 28, acting on the adaptors 17, are arranged on the two bearing journals 18, 19 of the nozzle beams 7, 8 for moving the nozzle beams 7, 8 in the direction of arrows b, c transverse to the running direction a of the rolling strip 6.

A rotary drive 29 is mounted on the side shields 20, 21, respectively, and engages a respective adaptor 17 for rotating the nozzle beams 7, 8 about their longitudinal axis 13—13

The connecting cables for the control valves 12 of the spray nozzles 11 of the nozzle beams 7, 8 are combined in several flexible protective hoses 30, wherein the length of the connecting cables of the control valves is dimensioned such that a rotation of the nozzle beams 7, 8 about the longitudinal axis 13—13 of the beam is possible.

Figure 3:
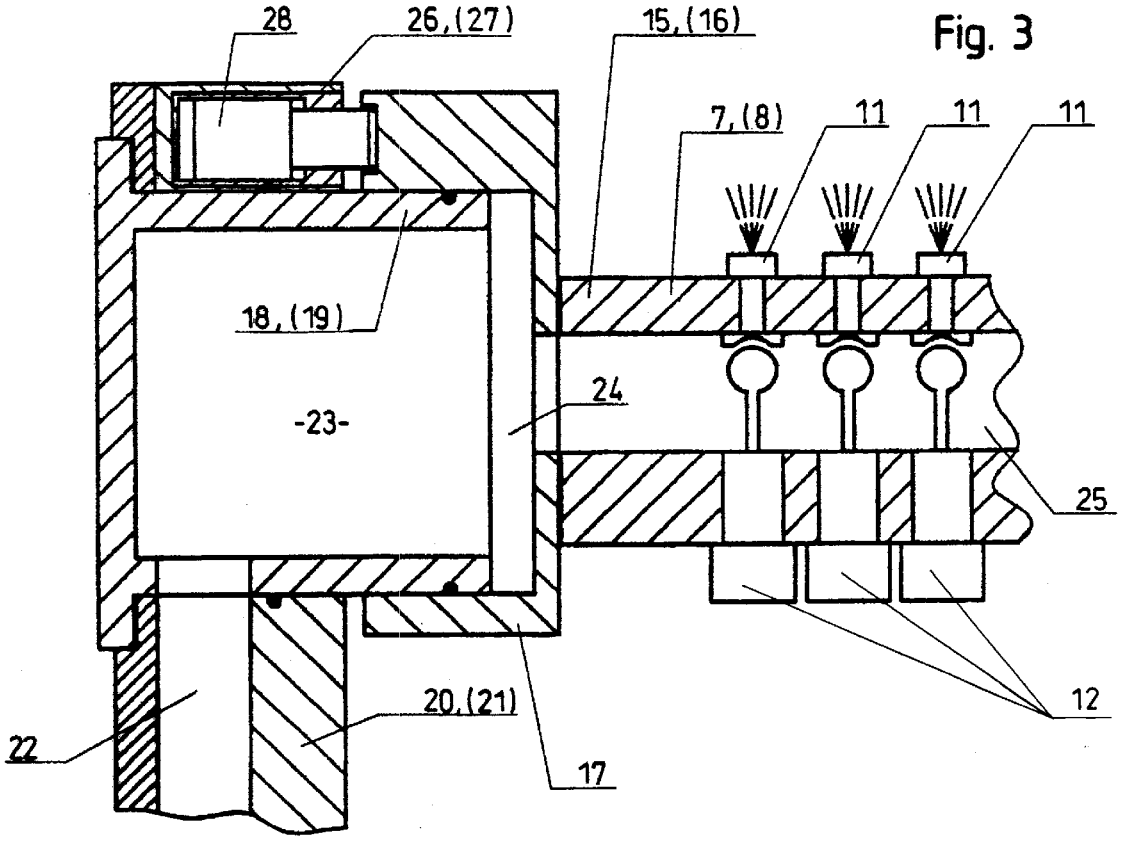
FIG. 3 is a section illustration of a rotational and sliding support of one end of a nozzle beam positioned in the working position.
Figure 4:
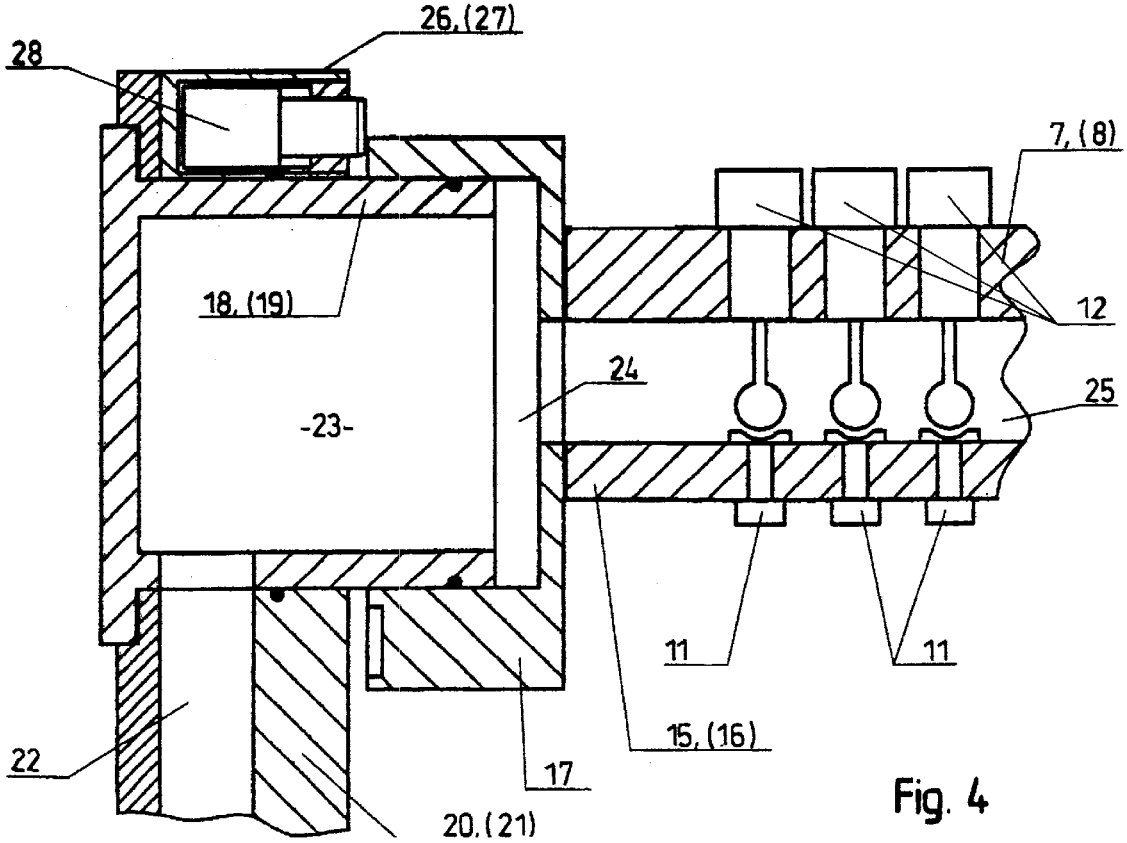
FIG. 4 is a section view of a rotational and sliding support of the nozzle beam in a maintenance position which is rotated by 180° relative to the illustration of FIG. 3.

For repair and maintenance work on the spray nozzles 11 the nozzle beams 7, 8 can be rotated from their working position according to FIG. 3 by 180° into the maintenance position according to FIG. 4 in which the spray nozzles 11 facing away from the working rollers 2, 3 are freely accessible. Maintenance and repair work on the control valves 12 of the nozzle beams 7, 8 are expediently performed in the working position of the nozzle beams according to FIG. 3.

In deviation from the afore described embodiment of the roller cooling and/or lubricating device, there is the possibility of providing additionally a movability and rotatability of the nozzle beams 9, 10 for the support rollers 4, 5 in the direction of the longitudinal beam axis, respectively, about the longitudinal beam axis.

Figure 5:
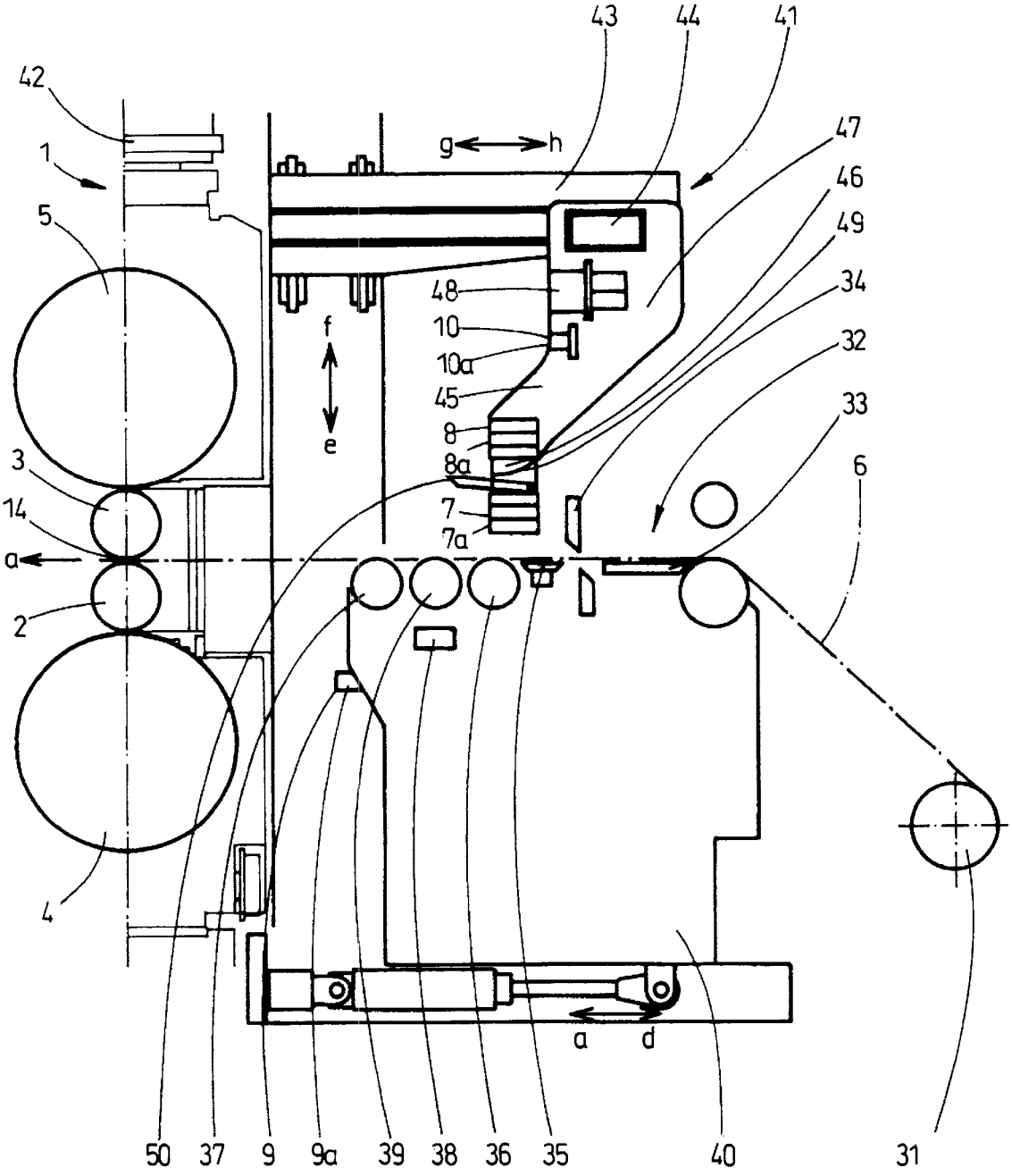
FIG. 5 is a four-high stand with nozzle beams in the maintenance position, a removal hasp, and devices for introducing the rolling strip into the rolling gap.
Figure 6:
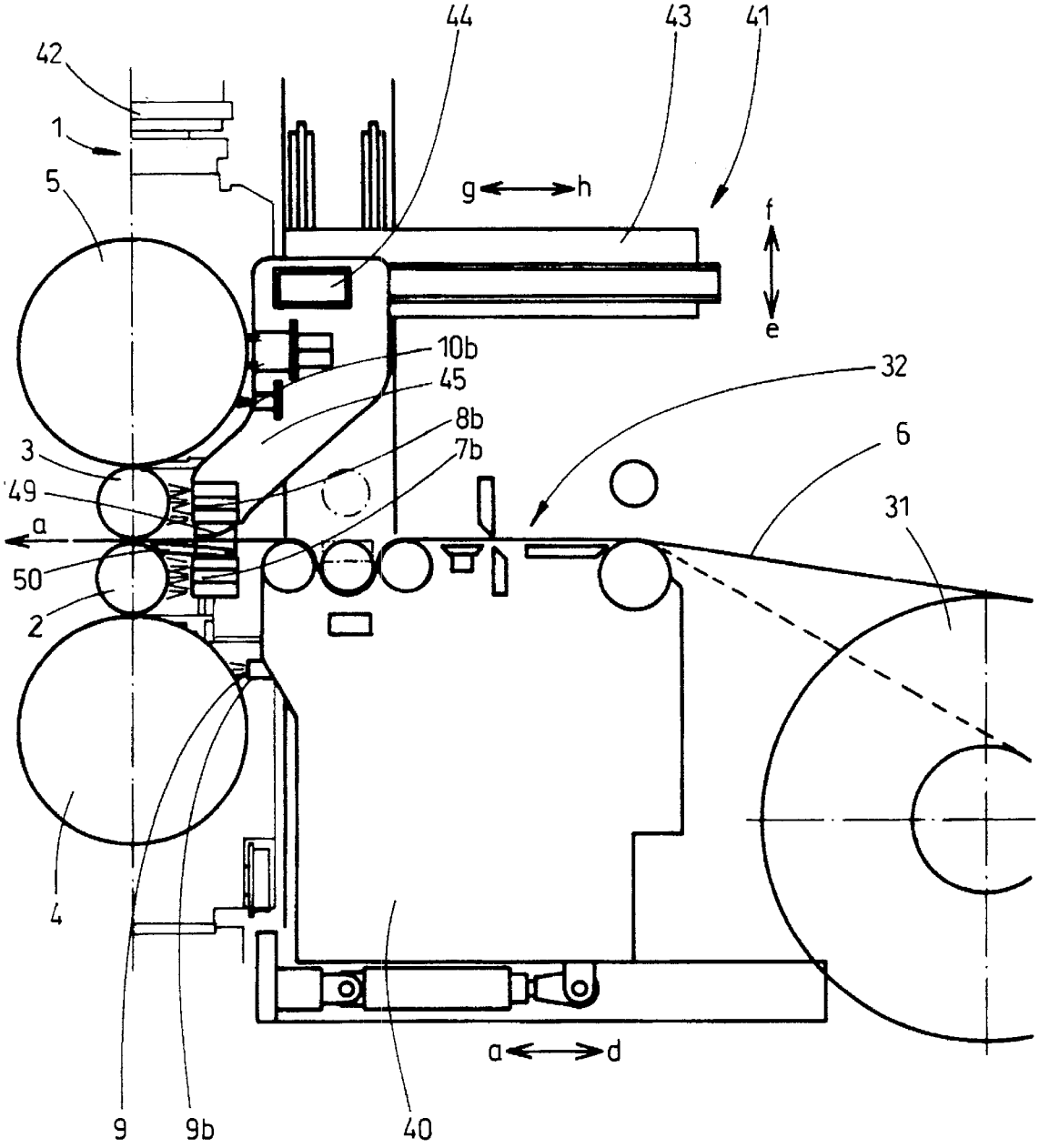
FIG. 6 shows the four-high stand corresponding to FIG. 5 with nozzle beam in the working position.

In the four-high stand 1 illustrated in FIGS. 5 and 6, the rolling strip 6 is removed from a removal hasp 31 and is guided into the rolling gap 14 via a strip introducing unit 32, which is comprised of a first air cushion conveyor 33, a separating blade 34, a second air cushion conveyor 35, a rolling unit with two deflecting rollers 36, 37, spaced in the strip running direction a at a spacing from one another, as well as a tension roller 39 arranged therebetween and combined with a third air cushion conveyor 38. The strip introducing unit 32 is arranged on the machine frame 40 which can be advanced in the strip running direction a and returned counter to the strip running direction in the direction of arrow d.

A positioning device 41 is arranged on the four-high stand 1 for moving two nozzle beams 7, 8 for the lower and the upper working rollers 2, 3 as well as a further nozzle beam 10 for the upper support roller 5 from the roller-remote maintenance position 7*a*, 8*a*, 10*a* into the working position 7*b*, 8*b*, 10*b* at the rollers 2, 3, 5.

The positioning device 41 is comprised of two lifting beams 43,arranged at the inlet side of the strip on the two roll housings 42 of the four-high stand 1 and movable in the vertical direction e, f, as well as two carriages 44 movable thereon in the horizontal direction g, h and having support arms 45 with right-angle bends. The two nozzle beams 7, 8 for the two working rollers 2, 3 are fastened on the lower ends 46 of the support arms 45, and the nozzle beam 10 and a stripper 48 for the outer support roller 5 are fastened on the upper portions 47.

Moreover, at the lower ends 46 of the support arms 45 of the carriages 44, deflecting plates 49, 50 for threading the rolling strip 6 into the rolling gap 14 are provided.

The nozzle beam 9 for the lower support roller 4 is arranged on the machine frame 40 of the strip introducing unit 32 which is movable in the direction of arrows a, d.

In a rolling train with several roll stands 1, starting at the second roll stand, the nozzle beam 9 for the lower support roller 4 can be mounted behind the removal hasp 31 on the extended lower ends 46 of the support arms 45 of the positioning device 41.

When moving the nozzle beams 7, 8, 10 from the maintenance position 7*a*, 8*a*, 10*a* illustrated in FIG. 5 into the working 7*b*, 8*b*, 10*b* according to FIG. 6, first the support arms 45 with the nozzle beams 7, 8, 10 are moved by means of the carriages 44 in the direction of arrow g in front of the strip introducing unit 32; subsequently, the nozzle beams 7, 8, 10 are lowered with the lifting beams 43 in the direction of arrow e to the working level; subsequently, the nozzle beams 7, 8, 10 are advanced with the carriages 44 into the working position 7*b*, 8*b*, 10*b* at the rollers 2, 3, 5 by means of the carriages 44; and then, the strip introducing unit 32 with the nozzle beam 9 for the lower support roller 4 is advanced in the strip running direction a toward the rollers.

The movement of the nozzle beams 7, 8, 10 and 9 from the working position 7*b*, 8*b*, 10*b*, 9*b* into the maintenance position 7*a*, 8*a*, 10*a*, 9*a* is carried out in the reverse sequence.

Figure 7:
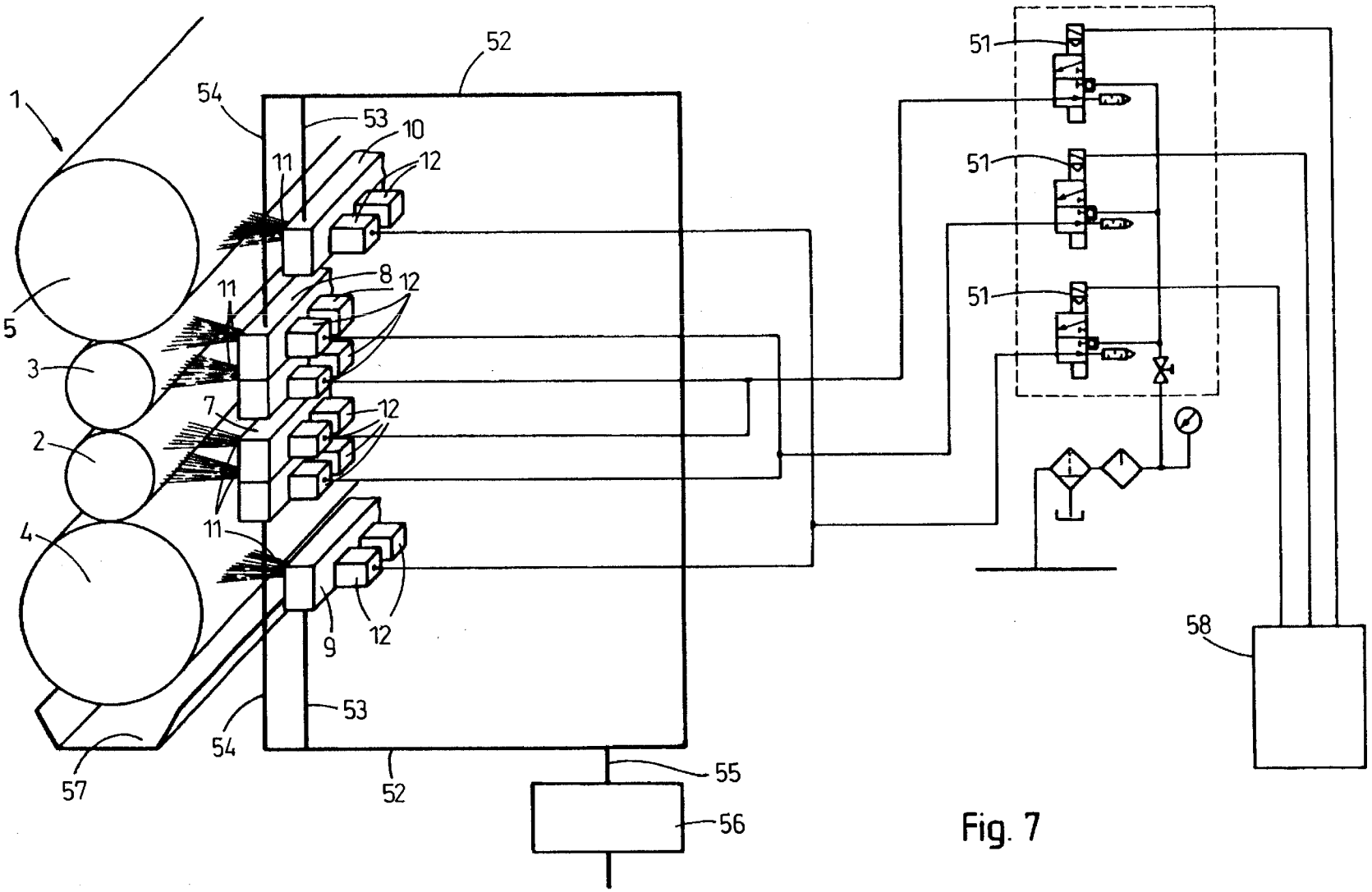
FIG. 7 shows the control of the spray nozzles for a four-high stand.

In the control, illustrated in FIG. 7, of the spray nozzles 11 of the nozzle beams 7–10 of a four-high stand 1 correlated with the working rollers 2, 3 and the support rollers 4, 5, the control valves 12 of the spray nozzles 11 are pneumatically pilot-controlled by solenoid valves 51.

Instead of the pneumatic pilot-controlled control valves 12 for the spray nozzles 11, control valves which are embodied as solenoid valves can also be used.

The nozzle beams 7–10 are connected via distribution lines 52–54 as well as a main supply line 55 for the cooling medium with the control valve 56 for pressure and quantity control of the cooling medium to a conveying pump, not shown, of a cooling medium circulation device.

When elongate portions occur in the rolled strip, which can be determined by the flatness measuring devices, cooling liquid is sprayed onto the working rollers 2, 3 and support rollers 4, 5 at these locations by means of the spray nozzles 11. Accordingly, the effective roll barrel diameter in this area is reduced by cooling. The cooling medium which flows away from the rollers is collected in a collecting tank 57 below the roll stand 1 and is returned into the cooling medium circulation device.

Opening or closing of the control valves 12 of the spray nozzles 11, for example, there may be 40 of them provided, is carried out in a certain sequence within a time frame of, for example, one second, i.e., the individual spray nozzles 11 are switched in time intervals of approximately 26 milliseconds. The switching sequence and the time intervals are controlled by a computer 58.

With such a control, a change of the liquid flows is achieved wherein pressure fluctuations can be prevented by means of a fast pressure control so that the flow-through quantity per control valve remains constant and no damaging liquid shocks can occur.

Figure 8:
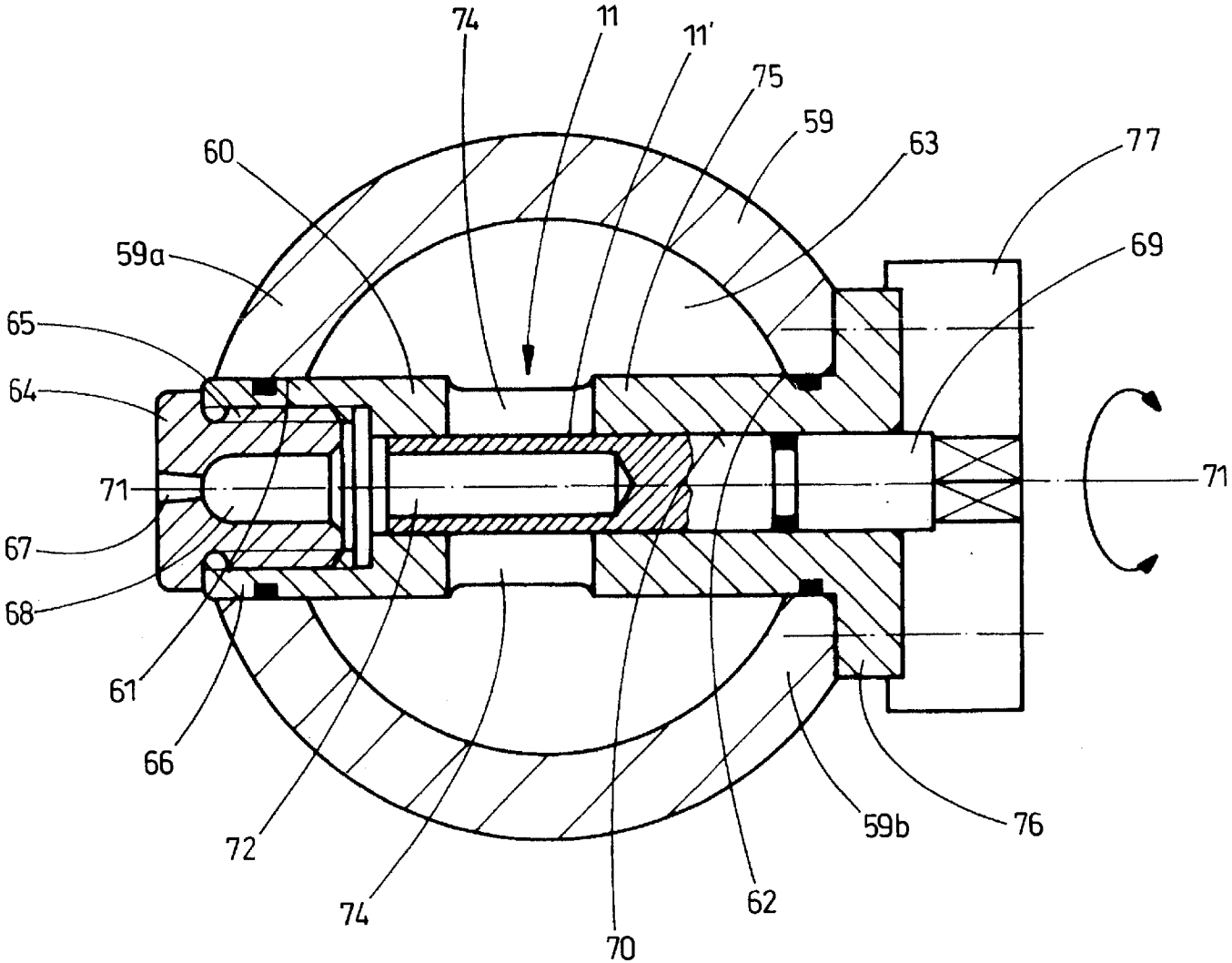
FIG. 8 is a longitudinal section of a spray nozzle provided with a rotary slide valve in the closed position.
Figure 9:
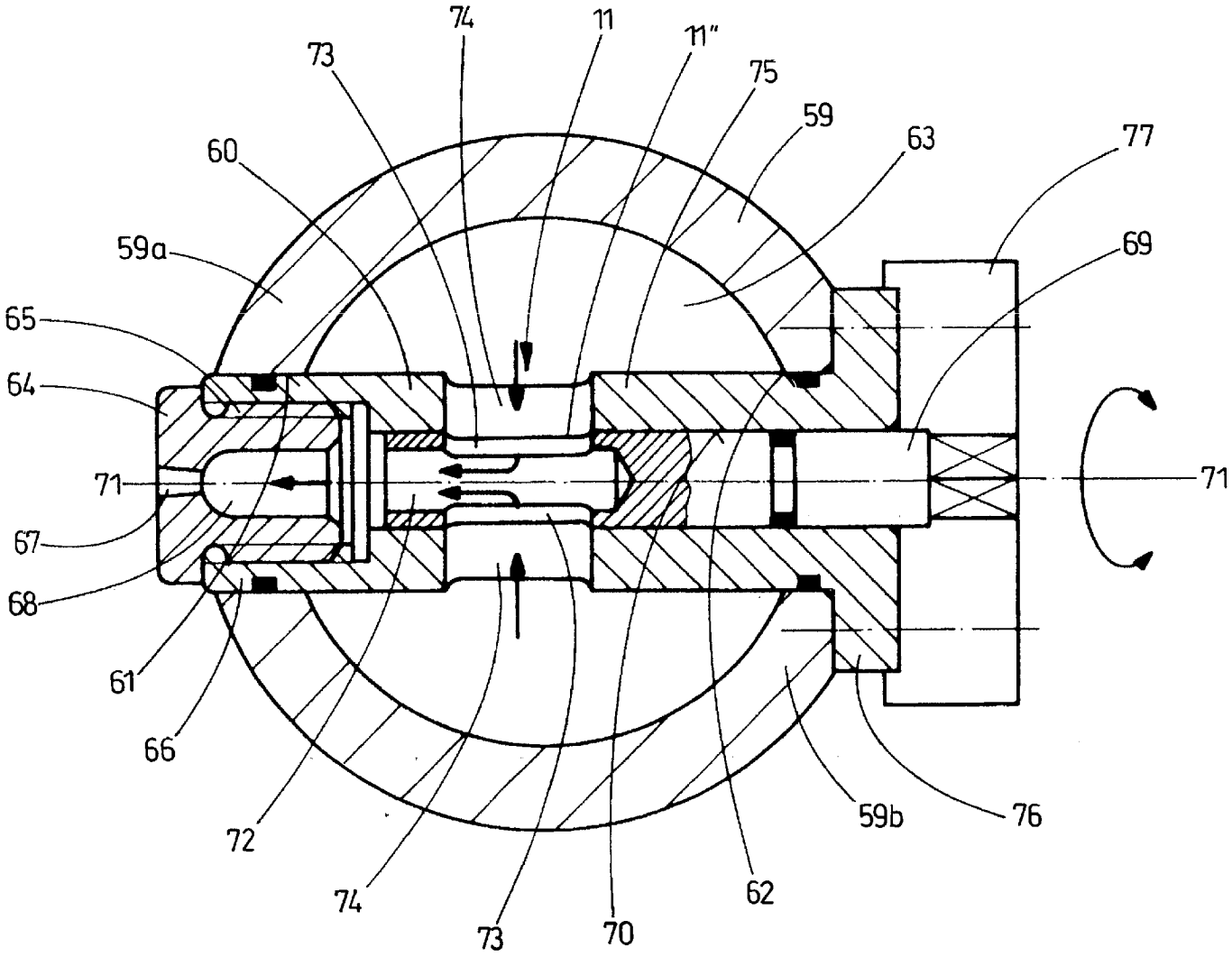
FIG. 9 shows in an illustration corresponding to FIG. 8 the spray nozzle in the open position.

According to FIGS. 8 and 9, the spray nozzles 11, positioned at identical spacing transverse to the strip running direction a in a cylindrical nozzle beam 59 of a roller cooling and lubricating device, are compact units mounted in the nozzle holders 60 which are inserted into corresponding openings 61, 62 in the front wall section 59*a* facing the roller as well as in the rear wall section 59*b* of the nozzle beam 59 from the backside thereof, are sealed relative to the nozzle beam 59, and penetrate the interior space 63 thereof.

The spray nozzles 11 are provided with a nozzle head 64 which is threaded into a threaded bore 65 in the forward end 66 of the nozzle holder 60 facing the roller. The nozzle head 64 has a nozzle opening 67 and an antechamber 68.

Moreover, the spray nozzles 11 are provided with a rotary slide valve 69 which is rotatably supported in a central throughbore 70 of the nozzle holder 60 so as to be rotatable about the longitudinal axis 71—71 of the spray nozzles 11. It is sealed in the bore 70 of the nozzle holder 60 and has a blind bore 72 open toward the nozzle head 64 as well as two diametrically oppositely positioned inlet openings 73 in the area of the blind bore 72. The inlet openings 73, in the open position 11'' of the spray nozzles 11 according to FIG. 9, are aligned with two inlet openings 74 in the nozzle holder 60, which are open to the interior 63 of the nozzle beam 59, and, in the closed position 11' of the spray nozzle 11 illustrated in FIG. 8, are closed by the wall 75 of the nozzle holder 60.

The nozzle holder 60 of the spray nozzle 11 is fastened by means of a flange 76, formed as a unitary part of the nozzle holder, to the external side of the rear wall section 59*b* of the nozzle beam 59 so as to be rotatable to a limited extent about the longitudinal axis 71—71 of the spray nozzle 11.

A control member 77 for actuating the rotary slide valve 69 of the spray nozzle 11 is mounted on the fastening flange 76 of the nozzle holder 60. The control member 77 may be an electric rotary solenoid, a hydraulic cylinder, or a pneumatic cylinder. Moreover, there is the possibility of employing a step motor for actuating the rotary slide valve 69 and for a simultaneous quantity control of the cooling and lubricating medium.

With respect to a spacing of the spray nozzle 11 as small as possible across the width 78 of the rolling strip 6, the control members 77 for actuating the rotary slide valve 69 of the spray nozzles 11 can be arranged in a staggered arrangement in the direction of the nozzle axes 71—71 and/or can be arranged staggered atop one another.

Moreover, there is the possibility of providing a rotary adjustment of the nozzle holders 60 in the nozzle beam 59 for changing the spray pattern of the individual spray nozzles, wherein a rotary drive for each nozzle holder 60 or a common rotary drive for several nozzle holders can be used.

Figure 10:
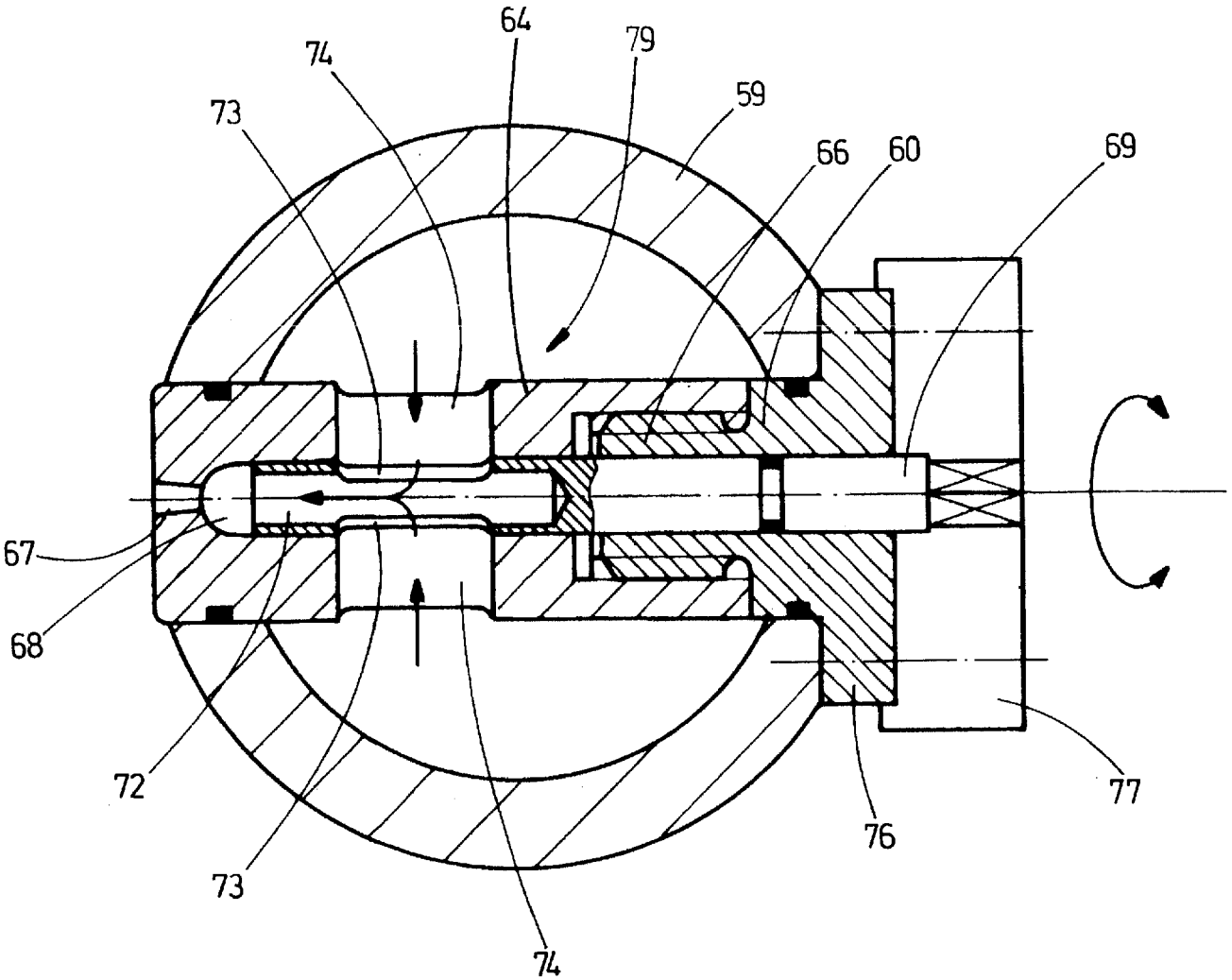
FIG. 10 shows an altered embodiment of the spray nozzle according to FIGS. 8 and 9.

In the further embodiment illustrated in FIG. 10 of a spray nozzle 79 with rotary slide valve 69, the extended spray head 64 is threaded onto the forward end 66 of the nozzle holder 60. In the nozzle head 64 two diametrically oppositely arranged inlet openings 74 are provided which cooperate with two inlet openings 73 in the area of the blind bore 72, that is open toward the antechamber 68 of the nozzle head 64, of the rotary slide valve 69, wherein the rotary slide valve 69 is centrally supported in the antechamber 68 of the nozzle head 64.

As a result of the small rotary stroke of the rotary slide valve 69, the spray nozzles 11, 79 are characterized by a fast control of the opening and closing processes which contributes to an optimal flatness control for thin strip and foil strip.

While specific embodiments of the invention have been shown and described in detail to illustrate the inventive principles, it will be understood that the invention may be embodied otherwise without departing from such principles.

What is claimed is:

1. A cooling and lubricating device for rollers of a cold rolling mill for strip having one or more roll stands for controlling tensile stress of the strip across the strip width by realizing at least one of a change of the effective roll barrel diameter and a change of the roller lubrication with a controlled supply of rolling oil or emulsions to the rollers, wherein the controlled supply is at least one of pressure-controlled, quantity-controlled, and temperature-controlled; the device comprising:

several nozzle beams having a longitudinal axis and being assigned to individual rollers, respectively;

the nozzle beams configured to be connected to side shields of a roll housing of the one or more roll stands;

spray nozzles mounted in the nozzle beams so as to be distributed across an entire width of the rollers;

the nozzle beams moveable relative to the correlated rollers and independently of one another transverse to a running direction of the strip running through the cold rolling mill and in planes positioned parallel to a plane of the strip;

one or more rotary drives connected to the nozzle beams and configured to rotate the nozzle beams about the longitudinal axis;

one or more linear drives connected to the nozzle beams and configured to move the nozzle beams in a direction of the longitudinal axis;

positioning devices provided on the one or more roll stands and configured to move the nozzle beams from a maintenance position remote from the rollers to a working position near the rollers and from the working position into the maintenance position;

wherein the control valves to be opened or closed are switched within a certain time frame with time delay;

wherein the spray nozzles are mounted with equal spacing to one another in the nozzle beam and have a nozzle holder, respectively, wherein the nozzle beam has a front wall section facing the assigned roller and a rear wall section opposite the front wall section, wherein the front and rear wall sections have openings in which the nozzle holders are seal-tightly seated so as to penetrate an interior of the nozzle beam;

wherein the nozzle holders have a forward end facing the assigned roller, respectively, and have a center throughbore;

wherein the spray nozzles have a nozzle head, respectively, and the nozzle heads are connected to the forward ends;

wherein the nozzle heads have at least one nozzle opening and an ante-chamber, respectively;

wherein the spray nozzles have a rotary slide valve, respectively, supported in the center throughbore so as to be rotatable about a longitudinal axis of the spray nozzle;

wherein the rotary slide valves have a blind bore, respectively, opening toward the nozzle heads, and further have at least one first inlet opening, respectively;

wherein the nozzle holders or the nozzle heads have at least one second inlet opening, respectively, opening to an interior of the nozzle beam;

wherein the at least one first inlet opening, in an open position of the spray nozzle, is aligned with the at least one second inlet opening and wherein the at least one first inlet opening, in the closed position of the spray nozzles, is covered by a wall of the nozzle holders or the nozzle heads;

wherein the spray nozzles have a control member, respectively, connected to the rotary slide valves at an end of the rotary slide valves facing away from the nozzle heads.

2. The device according to claim 1, wherein:

each one of the nozzle beams has opposed ends in the direction of the longitudinal axis;

each one of the nozzle beams has adapters connected to the opposed ends and a hollow bearing journal seated in the adapters and mounted in the side shields, respectively;

the adapters are configured to rotatably support the nozzle beams about the longitudinal axis and to slidably support the nozzle beams in the direction of the longitudinal axis on the two hollow bearing journals;

the spray nozzles have control valves;

the hollow bearing journals have hollow spaces;

the device further comprises a supply system configured to realize the controlled supply of the rolling oil and the emulsions to the spray nozzles and the control valves;

the supply system comprises a supply line arranged in at least one of the side shields and connected to the hollow space of the hollow bearing journal mounted in the at least one side shield and an interior space of the adapter seated on the hollow bearing journal;

the supply system further comprises a distribution channel in each one of the nozzle beams, wherein the distribution channels communicate with the interior space of the adapters;

the linear drive comprises adjusting cylinders seated on the hollow bearing journals of the nozzle beams and configured to act on the adapters for sliding the nozzle beams in the direction transverse to the running direction;

the rotary drive is configured to act on one of the adapters of the nozzle beams for rotating the nozzle beams about the longitudinal axis.

3. The device according to claim 1, further comprising:

lifting beams arranged on the roll housings of the roll stand at an inlet side for the strip and configured to be move vertically; and carriages mounted on the lifting beams and configured to move horizontally, wherein the carriages have support arms configured to support the nozzle beams.

4. The device according to claim 3, wherein the roll stand is a four-high stand, wherein the support arms have lower ends and upper portions, wherein at least one nozzle beam for a lower and an upper one of the rollers that are working rollers is fastened to the lower ends of the support arms, and wherein at least one nozzle beam and a stripper bar for an upper one of the rollers that is a support roller is fastened to the upper portions of the support arms.

5. The device according to claim 1, wherein the nozzle holders have an end facing the roller and wherein the end has a bore, respectively, wherein the nozzle heads are inserted into the bores.

6. The device according to claim 5, wherein the bores are threaded bores and the nozzle heads are screwed into the bores.

7. The device according to claim 1, wherein the nozzle holders have an end facing the roller, respectively, and wherein the nozzle heads are placed onto the ends.

8. The device according to claim 7, wherein the ends are threaded ends and the nozzle heads are screwed onto the ends.

* * * * *